United States Patent [19]

Norris

[11] 4,168,889

[45] Sep. 25, 1979

[54] TYPE CARRIER FOR USE IN PHOTOCOMPOSITION MACHINES

[75] Inventor: H. Coleman Norris, Pewaukee, Wis.

[73] Assignee: Columbian Art Works, Inc., Milwaukee, Wis.

[21] Appl. No.: 945,192

[22] Filed: Sep. 25, 1978

[30] Foreign Application Priority Data

Dec. 1, 1977 [GB] United Kingdom ..... 50208/77

[51] Int. Cl.[2] ..... B41B 13/10

[52] U.S. Cl. ..... 354/16

[58] Field of Search ..... 354/14, 15, 16, 17, 354/296

[56] References Cited

U.S. PATENT DOCUMENTS

| | | | |
|---|---|---|---|
| 2,742,830 | 4/1956 | Wirtz | 354/15 |
| 3,946,294 | 3/1976 | Scholten | 354/16 X |

*Primary Examiner*—Michael L. Gellner

*Attorney, Agent, or Firm*—Ira Milton Jones

[57] ABSTRACT

A type carrier for use in phototypesetting, comprising an opaque planar disc having at least two concentric circular rows of transparencies that define alpha-numeric characters, characterized in that the alpha-numeric characters in one of said circular rows are inverted duplicates of the alpha-numeric characters in the other of said rows.

4 Claims, 6 Drawing Figures

Fig. 3
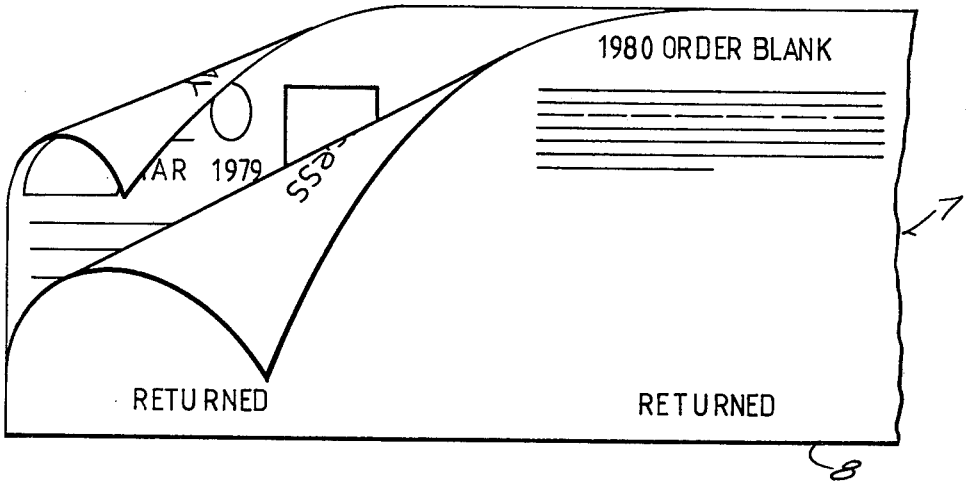
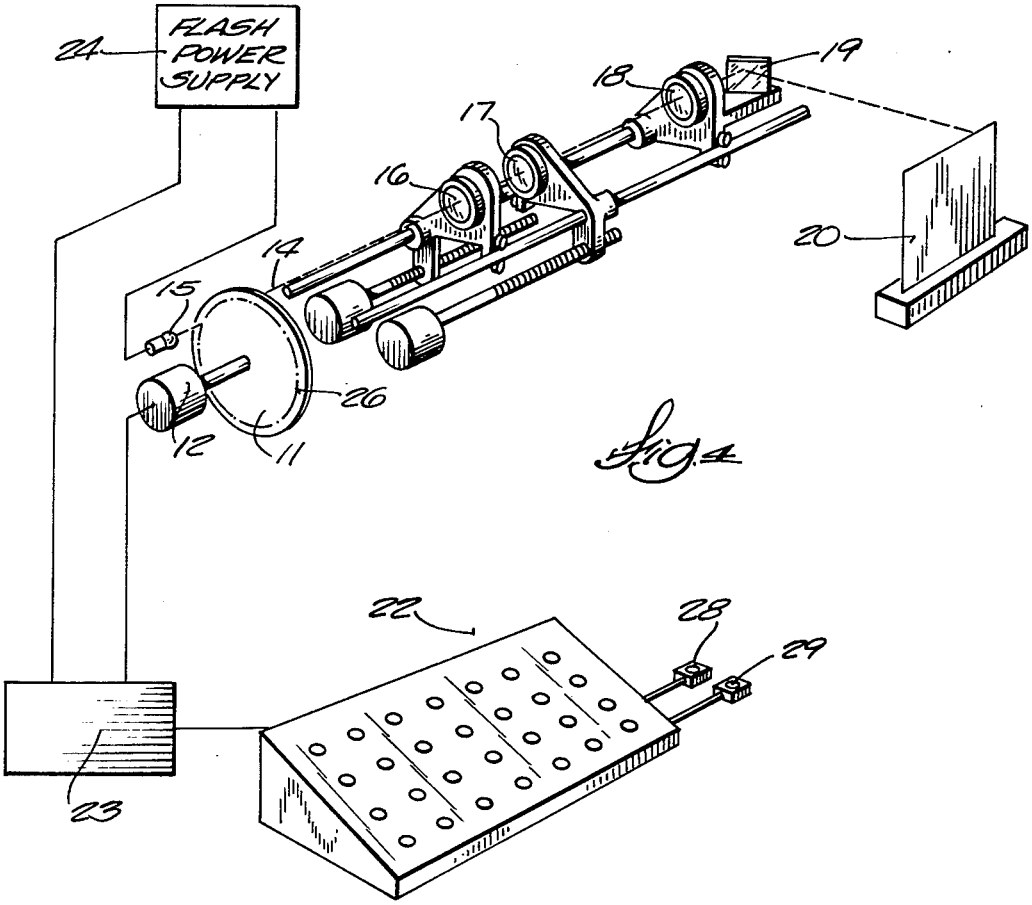
Fig. 4

TYPE CARRIER FOR USE IN PHOTOCOMPOSITION MACHINES

This invention relates to the preparation of printing plates for use in offset printing, and refers more particularly to the phototypesetting method of doing so. The advantages of phototypesetting over the old linotype technique are myriad, but it does not eliminate the need for translating copy into a form that can be used as a printing plate.

However, the translation of copy is far more easily accomplished by the phototypesetting method. It is usually done on keyboard-operated machines that include computerized instrumentalities to instantaneously record any operator-selected alpha-numeric character, be it a leter, numeral, or any other intelligence-conveying symbol, on photographic film or paper.

In the most widely used phototypesetting machines, the instrumentalities by which the operator's actuation or manipulation of the keyboard is translated into the photographically reproducible duplicate of the original copy, includes one or more rapidly rotating type discs, often called font discs. Examples of these discs are illustrated in the Freericks U.S. Pat. Nos. 3,922,086 and 3,982,054, and in the Masiello U.S. Pat. No. 4,047,188, all assigned to Addressograph Multigraph Corporation.

As explained in the Masiello patent, there are usually several fonts of alpha-numeric characters on each disc, each consisting of a circular row or ring of transparencies in an opaque background. These circular rows of alpha-numeric characters are concentric and of different diameters, one for each of a number of type styles as well as various other symbols or characters. In addition, there are several concentric circular rows of machine-readable indicia on the peripheral portion of the disc.

Cooperating with the rotating font disc, or the selected one of the discs if the machine is equipped with more than one, is a phptosensor that projects a light beam onto a photosensitive film or paper through the transparent symbol or character that corresponds to the key that was pressed by the operator of the machine in the type style the operator selected by pressing a type-style-choice key. The light source is at one side of the disc and the means by which the photosensitive film or paper is held is at the opposite side thereof.

Whatever relative motion may be required between the light source and the axis about which the type disc rotates to assure that the selected type style will be used, is automatically produced by the machine in response to the operator's depression or actuation of the chosen type style key. The alignment with the light beam of the selected alpha-numeric character in the selected type style is effected by the machine as a result of its reading the indicia on the marginal portion of the type disc that is identified with the operator-actuated symbol or character key.

The impingement of the light beam on the photosensitive film or paper creates images thereon of the selected alpha-numeric characters, and when a predetermined portion of the copy has been thus reproduced on the photosensitive film or paper, the latter is developed photographically, cut and pasted—along with other such reproductions of different portions of the copy—on a matrix sheet in preparation to being photographed to obtain a negative of the entirety; and from that negative, a positive is made directly on the flexible printing plate.

Pasteing the several reproductions onto the matrix sheet is a time-consuming operation which makes it desirable to have as much as possible of the reproduced copy in one piece, but heretofore this desirable work-reducing practice was severely curtailed by the fact that a large portion of all printing is done on sheets that are subsequently folded. For the printed matter on all pages of a folded sheet to be right-side-up and readable from left to right, every other one of the several reproductions had to be cut from its predecessor and rotated 180° before being pasted onto the matrix.

This invention eliminates that time consuming necessity, and does so in an extremely simple way. The only aspect of the described phototypesetting technique that is affected by the adaptation of the invention thereto is the type or font disc.

In accordance with this invention, for all of the type styles on the disc, there are duplicate sets of alpha-numeric characters, arranged in different ones of the concentric circular rows. In one such set the symbols or characters are right-side-up as they always have been; in the other set, they are upside-down. With that simple change, the need for handling and pasteing individual sheets of reproductions onto the matrix is reduced by at least fifty percent.

Correct orientation of the alpha-numeric characters on the photosensitive film or paper to assure that all portions of the printed copy will be readable from left to right, can be obtained by requiring the operator to type backwards while transposing that part of the copy for which the inverted characters are to be used. But, obviously, it is preferable that the machine be equipped with instrumentalities, including a conventional shift register that will automatically arrange the reproductions of the selected upside-down symbols or characters to read from left to right. The activation of those instrumentalities would be effected automatically as an incident to adjustment of the machine to bring the circular row containing the selected set of upside-down symbols or characters into position to have the characters thereof selectively movable into alignment with the light source.

The foregoing description may be sufficient to enable those skilled in the art to understand and practice the invention, but to assure a complete disclosure of the best mode of carrying the invention into practice, the accompanying drawings and following description are provided. In those drawings:

FIG. 3 is a perspective view of an end portion of the printed sheet shown in FIGS. 1 and 2, illustrating the same folded as it would be before its incorporation into the finished product;

Figure 5:
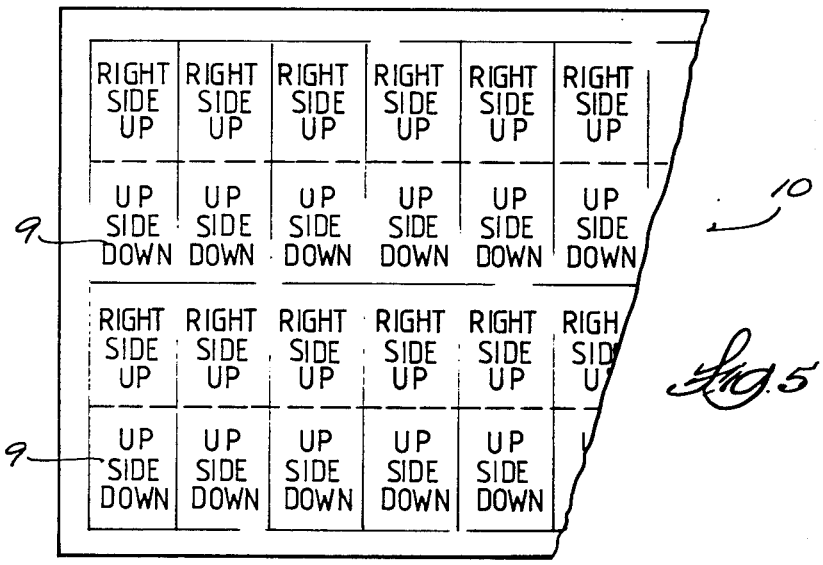
Figure 6:
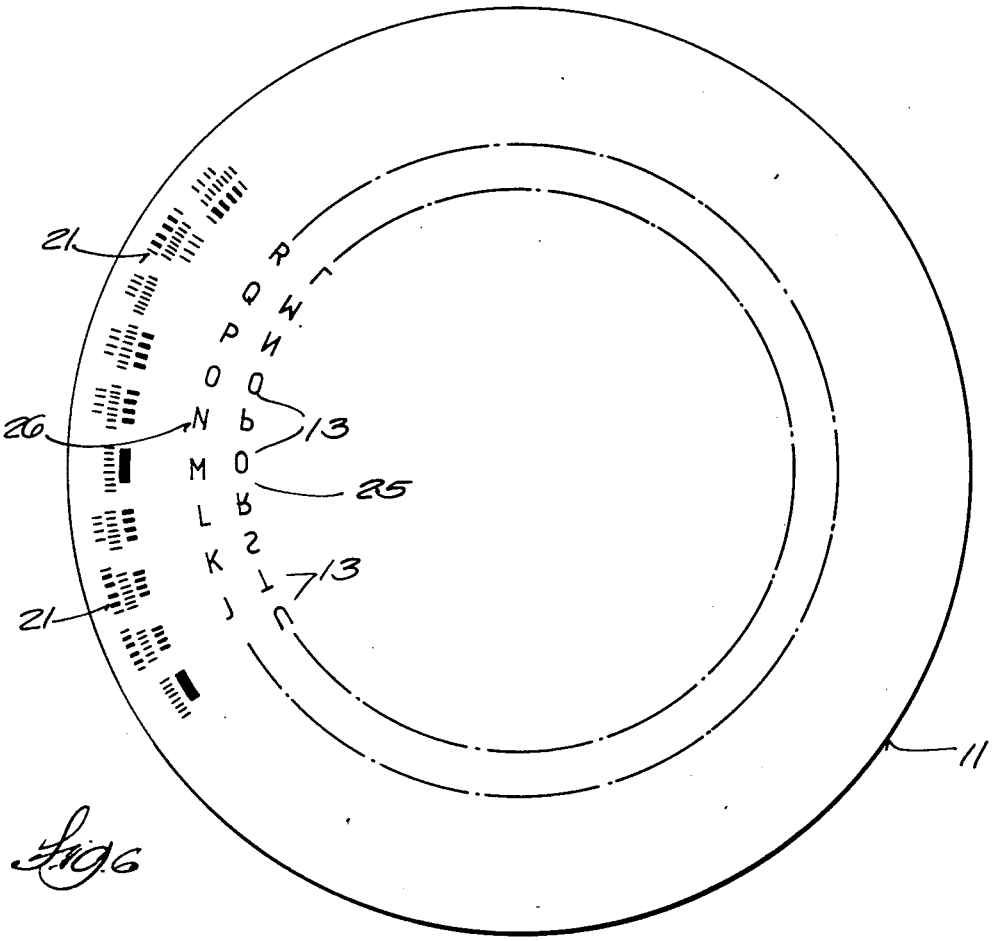

FIG. 4 diagrammatically illustrates an example of the machine or apparatus used in the phototypesetting technique to photographically reproduce successive portions of the original copy on photosensitive film or paper which, after being developed, is pasted on a matrix in preparation to being photographically duplicated in a form that lends itself to being used as a printing plate for offset printing;

FIG. 5 illustrates part of such a matrix with several of the reproductions of the original copy pasted thereon; and FIG. 6 is a plan view of a type disc or font disc embodying this invention.

Figure 1:
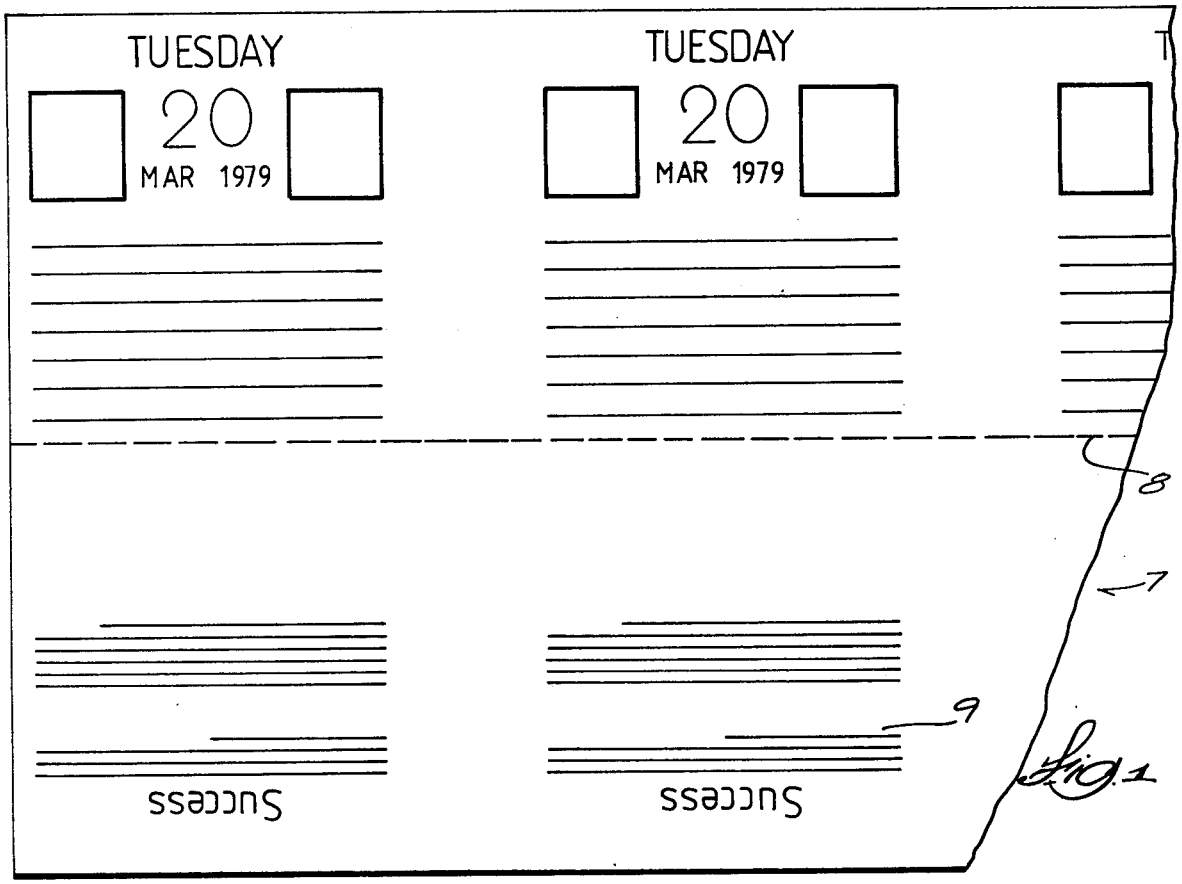
FIG. 1 illustrates one side of a portion of a printed sheet—more specifically, a component part in the production of pads for desk calendars—which, because of the need for folding the sheet preparatory to its being incorporated in the finished product, is an apt example of the many instances in printing wherein part of the copy must be printed upside-down.
Figure 2:
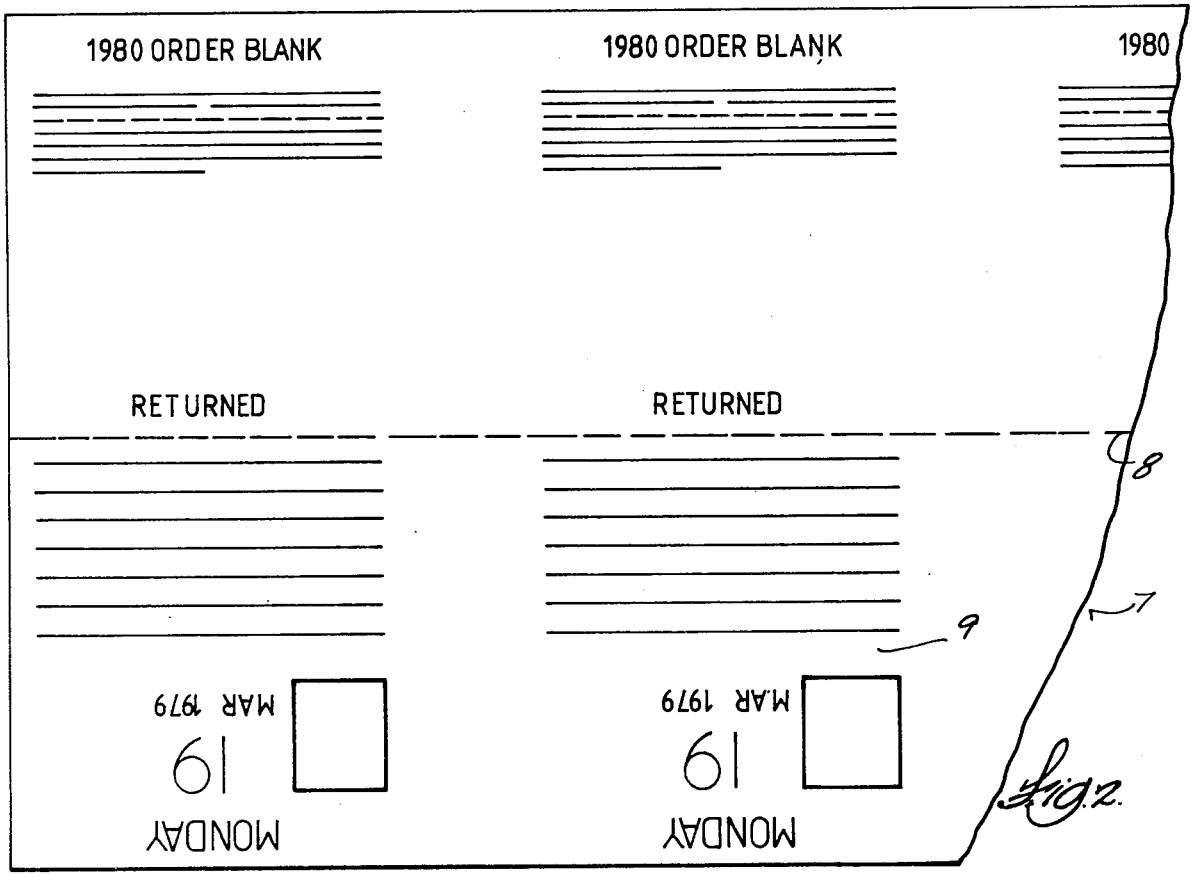
FIG. 2 illustrates the reverse side of the portion of the printed sheet shown in FIG. 1.

Referring to the drawings, the numeral 7, in FIGS. 1, 2 and 3, designates a portion of one of a plurality of side-by-side rows of sheets that are simultaneously printed on an offset type web press, severed from one another after being printed, then folded along a fold line 8, collated with other sheets of the same size but bearing different printed copy, and subsequently assembled into calendar pads.

Since the particular end result of the printing and folding operations forms no part of the present invention, the aforesaid reference to a calendar pad is merely illustrative of the many instances in which subsequent folding of a printed sheet entails half of the printing being done upside-down.

In the preparation of printing plates for offset printing by the phototypesetting technique, that requirement for upside-down printing necessitates at least half of the photographic reproductions 9 of successive portions of the original copy being pasted or otherwise mounted upside-down on a matrix 10, as shown in FIG. 5. Printing plates (not shown) that are photographically produced from the thus prepared matrix will have all of the alpha-numeric characters thereon properly oriented to meet the requirements of printing sheets that are subsequently folded.

The photographically produced reproductions 9 of the original copy are the product of the output of a conventional photocomposition machine such as that diagrammatically illustrated in FIG. 4, and likewise shown in the Booth et al U.S. Pat. No. 4,046,475 issued to Addressograph Multigraph Corporation on Sept. 6, 1977. The essential elements of that machine are a rotatable type disc 11 driven by an electric motor 12 to bring selected alpha-numeric characters 13 on the disc into alignment with a light beam 14 emanating from a light source 15 and projected through a series of lenses 16, 17 and 18 onto a mirror 19 by which the image of the selected character is projected onto a photosensitive film 20.

The type disc 11, or font disc as it is often called, which is usually cut from a sheet of flexible opaque material, has the alpha-numeric characters 13 formed thereon as transparencies arranged in concentric circular rows, usually one row for each of several font faces, to provide a selection of different type styles. Surrounding the concentric circular rows of alpha-numeric characters 13 are several circular rows of machine-readable indicia 21, also in the form of transparencies, that are identified with the characters 13 and enable the machine to automatically bring selected ones of those characters into alignment with the light source 15. The light source is a flash bulb or lamp which emits a high intensity short duration flash of light the instant the transparency 13 that forms a selected alpha-numeric character is brought into alignment therewith.

It is well known in the photocomposition art how to construct and operate a timing system by which the transparency 13 that forms a selected alpha-numeric character is brought into alignment with the light source. Conventionally it comprises a keyboard 22 that is operatively connected through suitable electronic circuitry, diagrammatically represented by the block 23, with the machine and particularly the motor 12 and a power source 24 that supplies current to the lamp 15. By virtue of the relationship of the machine-readable indicia on the peripheral portion of the type disc with the transparencies 13, manipulation of the keyboard activates the system as required to bring the selected alpha-numeric characters into alignment with the light source, and simultaneously energizes the light source as needed to translate original copy into an image thereof on the photosensitive film 20. After as much of the original copy as can be accommodated by the film has been projected onto it, the film is photographically developed, cut and pasted on the matrix 10.

Obviously, since the original copy usually requires many printed pages for its duplication, the reproduction of the original copy on the photosensitive film 20 is divided into successive sections or portions of a size that is a multiple of the size of the printed pages. The number of these sections or portions that are reproduced on a single piece of the film 20 depends upon the relative size of the printed pages and of the film 20.

Prior to this invention, it was not possible with available photocomposition machines to produce an inverted image of any portion of the original copy. Hence, in the pasteing operation by which the images on the developed film 20 are mounted on the matrix 10, those areas of the film which bore the images of the parts of the copy that—in the finished printed work—had to be upside-down, had to be cut therefrom and rotated 180° as they were mounted on the matrix. Since the pasteing operation is an exacting task, reduction in the number of individual pieces that have to be handled not only is a welcome innovation, but also significantly reduces the labor cost involved in the production of printing plates for offset printing.

This invention eliminates that need for cutting the developed film into smaller pieces, and instead enables the entire film—with the images of the original copy thereon just as they are—to be mounted in toto on the matrix. The invention achieves that objective by the simple expedient, illustrated in FIG. 6, of providing a duplicate circular row 25 of inverted alpha-numeric characters for each right-side-up row 26. By virtue of that relatively insignificant change, the machine is capable of producing images on the film 20 that are correctly oriented for all portions of the finished work, despite the fact that it is folded after being printed.

Obviously, of course, for all parts of the printed copy to be readable from left to right, those portions of the reproductions on the film 20 in which the characters are inverted require the operator of the keyboard to type backwards; but even that inconvenience can be avoided by providing the machine with instrumentalities, diagrammatically represented by the block 23, to automatically cause the inverted characters to be arranged right to left on the film 20 as the operator manipulates the keyboard in the customary way. A selector key 28 on the keyboard activates those instrumentalities.

In like manner, a type selector key 29 on the keyboard activates instrumentalities incorporated in the machine by which the operator can select which of the several fonts on the type disc will be used. It is that type selector key that is used to shift from the use of right-side-up to upside-down alpha-numeric characters.

Also, as can be readily appreciated, the operator's reading of the original copy can be locked into a memory bank of a computer, so that subsequent production of duplicate type discs can be accomplished automatically.

Those skilled in the art will appreciate that the invention can be embodied in forms other than as herein disclosed for purposes of illustration.

The invention is defined by the following claims:

I claim:

1. A type carrier for use in phototypesetting, comprising an opaque planar member having at least two concentric circular rows of transparencies that define alpha-numeric characters, characterized in that the alpha-numeric characters in one of said circular rows are inverted duplicates of the alpha-numeric characters in the other of said rows.

2. A type carrier for use in phototypesetting, comprising an opaque planar member with means thereon by which it can be mounted for rotation about a fixed axis perpendicular thereto, said member having a circular row of transparencies defining a font of alpha-numeric characters all of which are right-side-up with respect to the axis of rotation of said member, and equispaced from said axis to travel successively in a circular path concentric to said axis as said member is rotated, said type carrier being characterized in that said opaque planar member has another circular row of transparencies concentric to the aforesaid circular row thereof defining a font of alpha-numeric characters that is a duplicate of the aforesaid font of characters, but with all of the characters thereof upside-down with respect to said axis of rotation.

3. A type carrier for use in photocomposition machines, comprising a circular planar disc of substantially uniform thickness, having (1) means at its center defining an axis perpendicular to the plane of said disc about which the disc is rotatable, and (2) a circular row of transparencies concentric to said means so that said transparencies travel in a circular path as the disc is rotated, each of said transparencies defining one of a font of alpha-numeric characters all of which are right-side-up with respect to the axis about which the disc is rotatable, and said type carrier being characterized in that:

said disc has another circular row of transparencies concentric to the aforesaid row thereof, defining a duplicate font of said characters but inverted with respect thereto.

4. In a phototypesetting machine having a keyboard with keys identifying individual alpha-numeric characters, and instrumentalities to translate selective actuation of said keys into the production of images of successive portions of original copy, on a photosensitive sheet-like medium which upon being developed is adhesively mountable on a matrix preparatory to photographically producing a printing plate for offset printing, wherein said instrumentalities include an opaque disc with alpha-numeric characters thereon in the form of transparencies arranged in concentric circular rows, and means responsive to actuation of said keys to produce and project a light beam through a selected one of said transparencies and onto said photosensitive sheet-like medium, to thereby initiate the creation on said sheet-like medium of an image of the alpha-numeric character formed by the selected transparency. The improvement by which the preparation of a printing plate to be used in printing sheets that are subsequently folded is facilitated by having the images of adjacent portions of the original copy on the same sheet-like medium, despite the face that such subsequent folding requires the images of adjacent portions of the copy to be inverted with respect to one another, and which improvement is achieved by:

the provision on the opaque disc of circular rows of transparencies providing an upside-down alpha-numeric character for every right-side-up alpha-numeric character in the aforesaid circular rows of transparencies on the opaque disc, and means incorporated in the machine by which any one of said circular rows of alpha-numeric characters can be selectively brought into cooperative relation with the light beam.

* * * * *